United States Patent [19]

Creus

[11] 4,114,359

[45] Sep. 19, 1978

[54] DRIVEN SPINNING RING DEVICE FOR YARN MACHINES

[75] Inventor: Rufino Creus, Sabadell, Spain

[73] Assignee: Spurmach Espana S. L., Sabadell, Spain

[21] Appl. No.: 663,121

[22] Filed: Mar. 2, 1976

[30] Foreign Application Priority Data

Mar. 15, 1975 [ES] Spain ..... 435.657

[51] Int. Cl.[2] ..... D01H 7/58

[52] U.S. Cl. ..... 57/124; 57/75; 57/122; 57/104

[58] Field of Search ..... 57/75, 119, 120, 122, 57/124, 104

[56] References Cited

U.S. PATENT DOCUMENTS

| | | | |
|---|---|---|---|
| 2,034,762 | 3/1936 | Kuwada | 57/124 X |
| 2,541,238 | 2/1951 | Goree | 57/124 |
| 2,563,187 | 8/1951 | Pennati | 57/124 |
| 2,725,712 | 12/1955 | Rooney | 57/124 |
| 3,738,094 | 6/1973 | Costales et al. | 57/124 X |
| 3,777,468 | 12/1973 | Furst | 57/120 |

FOREIGN PATENT DOCUMENTS

| | | | |
|---|---|---|---|
| 14,346 of | 1903 | United Kingdom | 57/124 |

*Primary Examiner*—John Petrakes
*Attorney, Agent, or Firm*—Brumbaugh, Graves, Donohue & Raymond

[57] ABSTRACT

A spinning ring device for a yarn machine in which the traveller for guiding yarn in a winding operation is carried by a ring which in turn is carried by a ring holder mounted for rotation in the same direction as the traveller to reduce the drag effect of the traveller on the yarn.

10 Claims, 3 Drawing Figures

FIG. 2
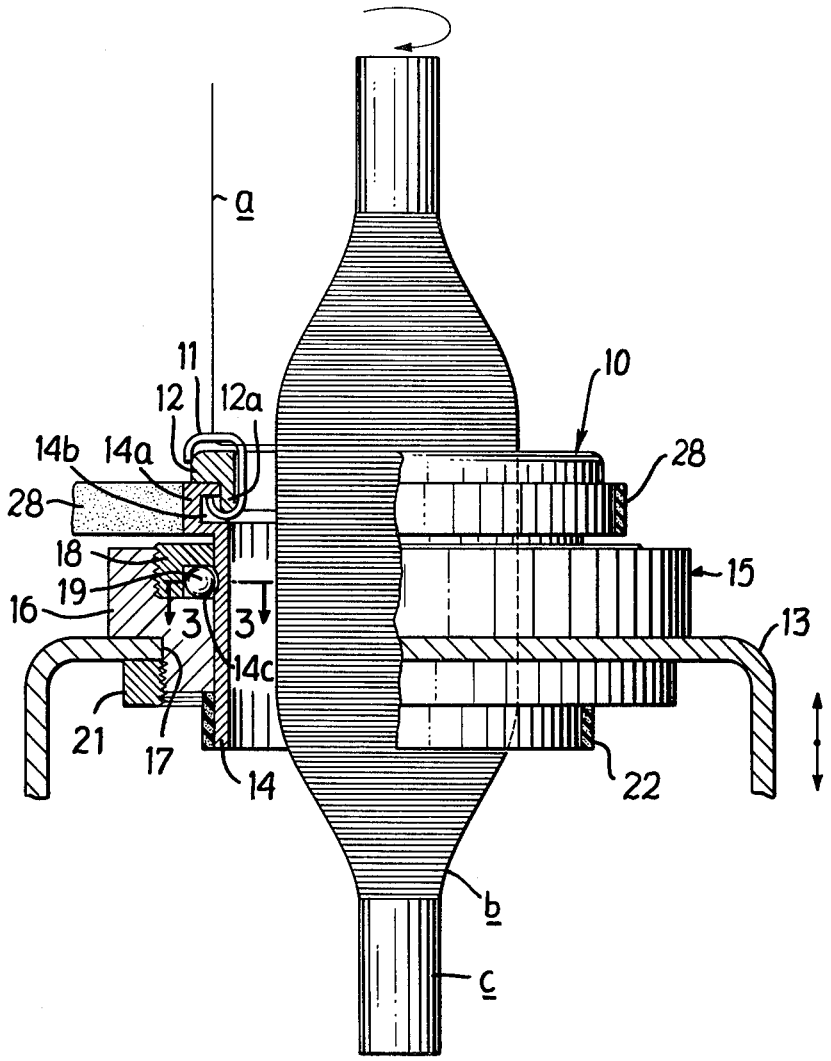
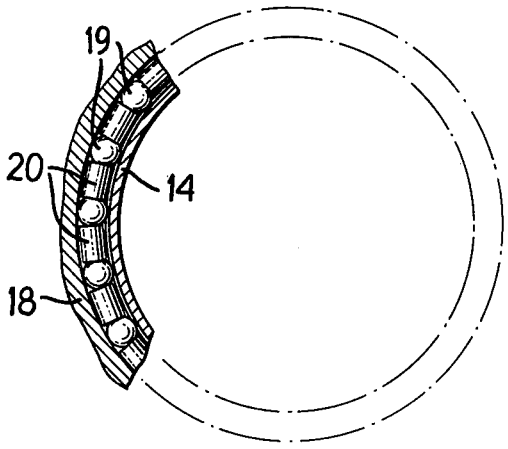
FIG. 3

DRIVEN SPINNING RING DEVICE FOR YARN MACHINES

BACKGROUND OF THE INVENTION

This invention relates to a spinning ring device for a yarn machine which has the ability to wind yarn at high speed and with minimum drag on the yarn to avoid breakage of the yarn.

In yarn winding operations the yarn is taken from a yarn package and wound at high speeds on a tubular spool or bobbin. The yarn is guided in the winding operation by a traveller supported for movement on the ring at high speeds around the winding axis under the influence of the yarn. The speed of the winding operation is limited by the friction between the traveller and the ring and the drag of the traveller on the yarn to prevent the drag of the traveller on the yarn from causing breakage of the yarn. Breakage of the yarn necessitates shutting down the operation of the machine and results in an inefficient and uneconomical yarn winding operation.

The present invention provides a novel spinning ring device in which the ring holder is mounted for rotation and driven in the direction in which the traveller is moved by the winding of the yarn around the axis, thereby decreasing the relative movement between the traveller and the ring in the winding operation and decreasing the drag of the traveller on the yarn.

The improved spinning ring device of the present invention embodies, inter alia, a novel rotational mounting for the ring holder and a novel drive transmission means which imparts rotary motion to the ring holder while the ring holder is moved along the winding axis to wind the yarn uniformly on the tubular spool or bobbin.

For a complete understanding of the present invention, reference can be made to the detailed description which follows and to the accompanying drawings in which:

FIG. 2 is an elevational view, partly in cross-section, of a spinning ring device embodying the present invention; and FIG. 3 is a view taken along the line 3—3 of FIG. 2 looking in the direction of the arrows.

Figure 1:
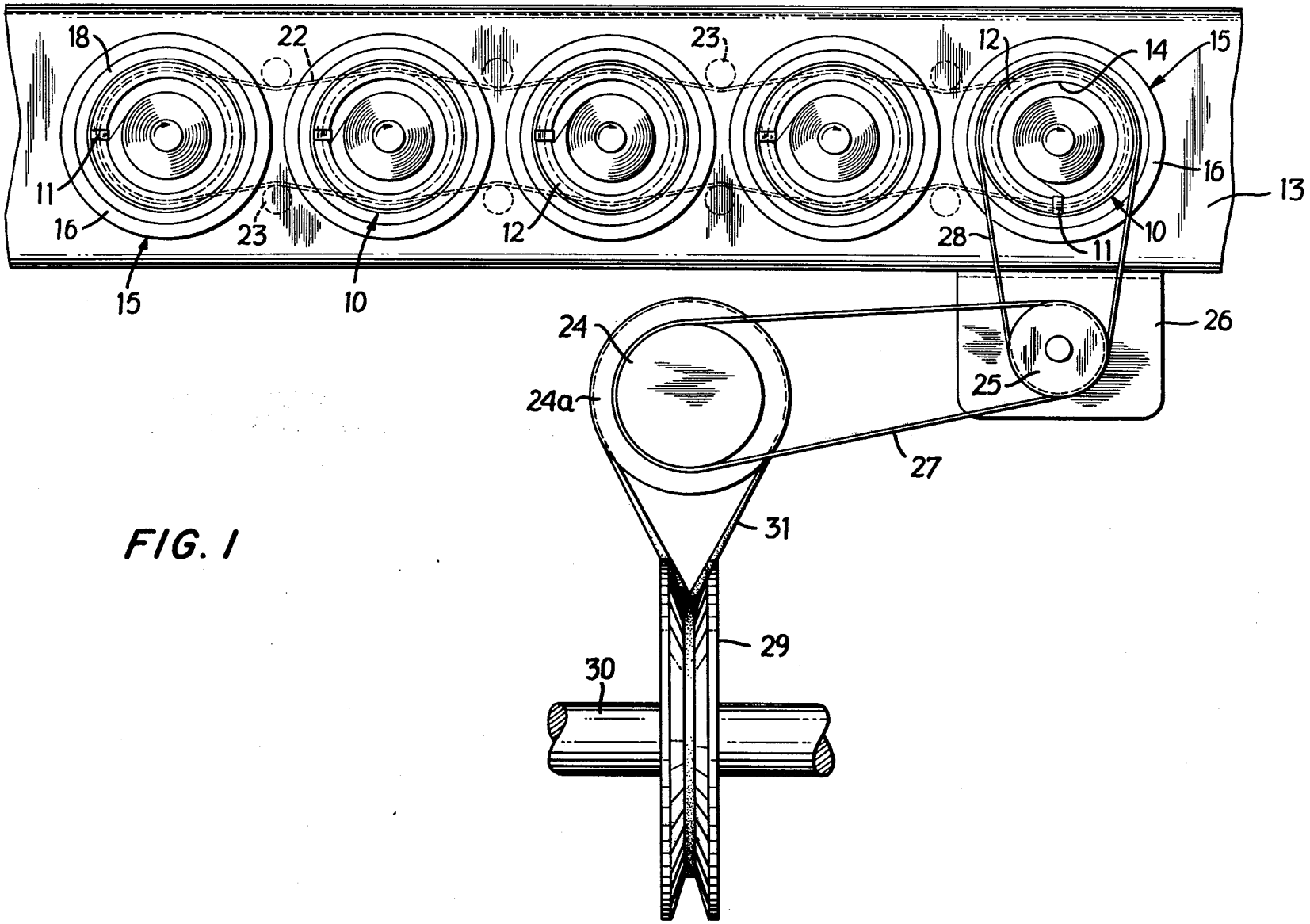
FIG. 1 is a plan view showing the drive transmission system for a plurality of the spinning ring devices.

Referring to FIG. 2 of the drawings, yarn *a* taken from an overhead package passes through a drafting and twisting mechanism (not shown) and is wound on a tube *b* carried by a rotating spindle *c*. The yarn is guided onto the tube by a spinning ring device designated by the reference numeral 10. The spinning ring device includes a traveller 11 accommodated on a ring 12. As the spindle rotates at high speed drawing the yarn onto the tube, the traveller 11 moves at high speed on the ring 12 around the axis of the spindle *c* to guide the yarn onto the tube.

A plurality of spinning ring devices 10 is mounted along a supporting rail or platform 13. The supporting rail or platform 13 moves vertically displacing the spinning ring devices 10 carried thereby longitudinally along the axes of the respective tubes *b* in order to wind the yarn uniformly on the tubes.

The spinning ring device 10 includes, in addition to the traveller 11 and the supporting ring 12 therefor, a driven ring holder 14 rotatably mounted in the supporting rail or platform 13 by a bearing 15. The bearing 15 includes a bearing support 16 accommodated in an opening 17 in the top of the platform 13, a bearing retainer 18 threaded into a recess formed in the top of the bearing support 16 and a plurality of bearings 19 and bearing separators 20 interposed between the bearing support 16 and the bearing retainer 18. A nut 21 is threaded on the lower end of the bearing support 16 and engages the underside of the platform 13 to retain the bearing securely therein.

The upper end of the ring holder 14 has an enlarged neck **14*a* having an internal recess 14*b*. The ring 12 rests on top of the neck 14*a* and has a depending flange 12*a* which fits snugly within the inner periphery of the neck 14*a*. The traveller 11 is a flattened rigid bar of generally C-shaped formation which extends from the outer periphery of the ring 12 and bows around the upper and inner portions of the ring with the opposite end thereof being accommodated within the recess 14*b* of the ring holder. The bearings 19 and bearing separators 20 ride in a recess 14*c* formed in the outer periphery of the ring holder 14. The lower end of the ring holder is driven by a belt 22** in the same direction as the direction of rotation of the spindle *c* and the direction of the traveller 11 on the ring 12.

The traveller 11 travels freely along the ring 12 under the influence of the yarn as the yarn is wound at high speed on the tube *b* rotating on the spindle *c*. The ring 12 and ring holder 14 are also driven by the belt 22 at high speed in the same direction as the traveller in order to reduce the relative movement between the traveller and the ring and the drag effect of the traveller on the yarn.

The spacers 20 provide the lubrication for the ball bearings 19. The spacers are tubular elements made of synthetic material, such as nylon or Delrin, filled with lubricant and interposed between a pair of steel ball bearings. The ball bearings have access to the lubricant through the annular ends of the separators.

The drive transmission for a plurality of the spinning ring devices is shown in FIG. 1. The belt 22 is driven in a closed path in engagement with a plurality of ring holders 14. A plurality of pulleys 23 mounted beneath the platform 13 and interposed between the spinning ring devices 10 increases the frictional engagement between the belt and the ring holders 14. The belt 22 is driven from a driven cylindrical shaft 24 through a cylindrical idler shaft 25 rotatably mounted in an extension 26 of the platform 13. A belt 27 connects the shafts 24 and 25, and a belt 28 connects the shaft 25 with the outer periphery of the neck **14*a* of one of the ring holders. As the platform 13 moves vertically the belt 27 rides up and down one of the shafts 24 and 25**.

The shaft 24 accommodates a pulley **24*a* thereon, and the shaft 24 is driven from a pulley 29 mounted on a driven shaft 30 through a crossed transmission belt 31 connecting the pulleys 24*a* and 29**.

The invention has been shown in a single preferred form and by way of example, and obviously many modifications and variations may be made therein within the spirit of the invention. The invention, therefore, is not to be limited to any particular form or embodiment, except in so far as such limitations are expressly set forth in the claims.

I claim:

1. A spinning ring device for a yarn machine comprising a traveler for guiding yarn in a winding operation about a winding axis, a support ring for the traveler for guiding it in a circular path around the winding axis under the influence of the yarn, a mounting for supporting the ring on the winding axis, a ring holder rotatably mounted in said mounting to enable the ring to rotate in the same direction as the traveler to decrease the relative movement between the ring and the traveler, a stationary bearing support accommodated by the mounting and receiving the ring holder rotatably therein, bearing means interposed between said stationary bearing support and said ring holder to permit the ring holder to rotate within said bearing support, a pair of drive transmitting surfaces formed on the ring holder, driving means in engagement with one of said surfaces for driving the ring holder and driven means in engagement with the other of said surfaces for transmitting drive from the ring holder to at least one other ring holder.

2. A spinning ring device as set forth in claim 1 in which motion is imparted to the mounting in the direction of the axis of the ring holder and in which the driving means includes drive belt means carried with the mounting and engaging one of the said drive transmitting surfaces and an elongated drive shaft in driving engagement with said drive belt means and having an axis parallel to the axis of rotation of the ring holder so that the drive belt means moves longitudinally along the drive shaft.

3. A spinning ring device as set forth in claim 1 in which one of the drive transmitting surfaces includes a drive transmitting surface located on one side of the stationary bearing support and the other includes a drive transmitting surface located on the opposite side of the stationary bearing support.

4. A spinning ring device as set forth in claim 1 including a recessed bearing ring race formed in the outer periphery of the ring holder, a bearing recess formed in one end of said bearing support for accommodating the bearings therein in engagement with the recessed bearing race formed in the outer periphery of the ring holder, and a bearing retainer closing said end of the bearing support for retaining the bearings within the recessed bearing race.

5. A spinning ring device for a yarn machine comprising a traveler for guiding yarn in a winding operation about a winding axis, an annular support ring for the traveler for guiding it in a circular path around the winding axis under the influence of the yarn, a stationary bearing support accommodating bearings for supporting the ring on the winding axis, an annular ring holder rotatably mounted in said bearing support to enable the ring to rotate in the same direction as the traveler to decrease the relative movement between the ring and the traveler, an internal annular surface in the upper end of the ring holder, an integrally formed flange on the ring telescoping into said internal annular surface at the upper end of the ring holder, a recess formed in the ring holder adjacent the lower outer region of the ring flange, said traveler extending from the outer periphery of the ring across the upper end thereof and then downwardly terminating in a lower hook end which enters the recess, a pair of drive transmitting surfaces on the ring holder, one below the stationary bearing support and the other above the stationary bearing support, a driving belt in engagement with one of said surfaces for driving the ring holder, and a driven belt in engagement with the other of said surfaces for transmitting drive from the ring holder to another ring holder.

6. A spinning ring device as set forth in claim 5 including an annular recess in the outer periphery of the ring holder and at least partially receiving the bearing therein for rotatably supporting the ring holder.

7. A spinning ring device as set forth in claim 5 in which the bearings are ball bearings and including tubular separators intermediate pairs of ball bearings and containing a lubricant which is accessible to the ball bearings through the ends of the tubular separators.

8. A spinning ring device as set forth in claim 7 in which the separators are made of lightweight synthetic material.

9. A spinning ring device as set forth in claim 6 including a bearing recess formed in one end of said bearing support for accommodating the bearings therein to engage the annular recess in the ring holder, a bearing retainer closing said open end of said bearing support and a bearing race for the bearings defined by surfaces of the bearing support and the bearing retainer cooperating with said annular recess.

10. A spinning ring device as set forth in claim 5 including a platform which carries a plurality of rotatably mounted ring holders up and down the winding axis and in which the driven belt is a common belt in frictional engagement with said plurality of ring holders.

* * * * *